US008852528B2

(12) United States Patent
Thomson et al.

(10) Patent No.: US 8,852,528 B2
(45) **Date of Patent: *Oct. 7, 2014**

(54) FRAGRANCE PRODUCT, DISPENSER, AND DISPENSER ASSEMBLY

(75) Inventors: James Thomson, Hudson, OH (US); Julia DiCorleto Gibson, Bedford, MA (US); John Boyle, Cleveland, OH (US); Kevin Gray, Nashua, NH (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/186,285

(22) Filed: Jul. 19, 2011

(65) Prior Publication Data

US 2012/0067925 A1 Mar. 22, 2012

Related U.S. Application Data

(63) Continuation of application No. 12/766,538, filed on Apr. 23, 2010, now abandoned, which is a continuation of application No. 11/374,298, filed on Oct. 11, 2005, now Pat. No. 7,722,819.

(51) Int. Cl.

| | |
|---|---|
| ***B65D 83/00*** | (2006.01) |
| ***B05B 11/00*** | (2006.01) |
| ***B05B 15/00*** | (2006.01) |
| *B05B 11/06* | (2006.01) |

(52) U.S. Cl.

CPC ..... *B05B 11/00* (2013.01); *B05B 11/30* (2013.01); *B05B 11/0037* (2013.01); *B05B 11/06* (2013.01); *B05B 15/00* (2013.01); *B05B 15/005* (2013.01)

USPC ..... 422/505; 422/508; 222/383.1; 222/321.7; 222/321.9

(58) Field of Classification Search

USPC ..... 222/383.1, 464.1, 394; 422/505, 508; 138/177

See application file for complete search history.

(56) References Cited

U.S. PATENT DOCUMENTS

| | | | | |
|---|---|---|---|---|
| 2,869,417 A | | 1/1959 | Allen | |
| 2,962,196 A | * | 11/1960 | Ayres | 222/399 |
| 3,342,377 A | | 9/1967 | Peredy | |

(Continued)

FOREIGN PATENT DOCUMENTS

| | | | |
|---|---|---|---|
| EP | 0092675 A1 | * | 8/1983 |
| EP | 0 092 675 | | 11/1983 |

(Continued)

OTHER PUBLICATIONS

Teflon/Tefzel "Extrusion Guide for Melt-Processible Fluoropolymers". DuPont, Mar. 1993.*

(Continued)

*Primary Examiner* — Krishnan S Menon
*Assistant Examiner* — Dwan A Gerido
(74) *Attorney, Agent, or Firm* — Finnegan, Henderson, Farabow, Garrett & Dunner, L.L.P.

(57) ABSTRACT

A fragrance product is disclosed including a container containing liquid fragrance and a dispenser assembly for dispensing the liquid fragrance including a transport assembly and a tube connected to the transport assembly and extending into the liquid fragrance. The tube and the liquid fragrance each have a refractive index, and the difference between the refractive index of the tube and the liquid fragrance is not greater than about 0.04.

9 Claims, 5 Drawing Sheets

(56) References Cited

U.S. PATENT DOCUMENTS

| | | | | |
|---|---|---|---|---|
| 3,427,375 | A | 2/1969 | Turner | |
| 3,463,093 | A | 8/1969 | Pfeiffer et al. | |
| 3,553,303 | A | 1/1971 | Zavasnik | |
| 3,608,555 | A | 9/1971 | Greyson | |
| 3,759,806 | A | 9/1973 | Doctor | |
| 3,817,951 | A | 6/1974 | Robinson | |
| 3,839,213 | A | 10/1974 | Hill | |
| 3,929,943 | A | 12/1975 | Klimaszewski, Jr. | |
| 3,969,023 | A | 7/1976 | Brandt et al. | |
| 4,017,575 | A | 4/1977 | Heyer | |
| 4,418,846 | A | 12/1983 | Pong et al. | |
| 4,552,925 | A | 11/1985 | Nakagawa et al. | |
| 4,585,306 | A | 4/1986 | Ohmori | |
| 4,657,805 | A | 4/1987 | Fukumitsu et al. | |
| 4,663,152 | A | 5/1987 | Barth et al. | |
| 4,677,175 | A * | 6/1987 | Ihara et al. | 526/254 |
| 4,743,480 | A | 5/1988 | Campbell et al. | |
| 4,747,662 | A | 5/1988 | Fitz | |
| 5,226,538 | A | 7/1993 | Roselle | |
| 5,246,752 | A | 9/1993 | Raczkowski | |
| 5,317,061 | A | 5/1994 | Chu et al. | |
| 5,374,683 | A | 12/1994 | Morgan | |
| 5,403,454 | A | 4/1995 | Taniguchi et al. | |
| 5,468,725 | A * | 11/1995 | Guenin et al. | 512/2 |
| 5,538,510 | A | 7/1996 | Fontirroche et al. | |
| 5,703,185 | A | 12/1997 | Blair | |
| 5,759,329 | A | 6/1998 | Krause et al. | |
| 5,820,594 | A | 10/1998 | Fontirroche et al. | |
| 5,824,173 | A | 10/1998 | Fontirroche et al. | |
| 5,898,475 | A | 4/1999 | Martin | |
| 5,981,004 | A | 11/1999 | Kostic | |
| 6,024,722 | A | 2/2000 | Rau et al. | |
| 6,039,084 | A | 3/2000 | Martucci et al. | |
| 6,068,370 | A | 5/2000 | Miller et al. | |
| 6,073,373 | A | 6/2000 | Haugk et al. | |
| 6,106,857 | A | 8/2000 | Crotty et al. | |
| 6,119,897 | A | 9/2000 | Boileau | |
| 6,174,479 | B1 | 1/2001 | Gilliard et al. | |
| 6,197,904 | B1 | 3/2001 | Gangal et al. | |
| 6,233,856 | B1 | 5/2001 | Haugk et al. | |
| 6,276,566 | B1 | 8/2001 | Zaksenberg | |
| 6,309,714 | B1 | 10/2001 | Gaither | |
| 6,372,870 | B1 | 4/2002 | Kitahara et al. | |
| 6,403,109 | B1 | 6/2002 | Stora | |
| 6,481,149 | B1 | 11/2002 | Hall, IV et al. | |
| 6,488,659 | B1 * | 12/2002 | Rosenman | 604/113 |
| 6,515,649 | B1 | 2/2003 | Albert et al. | |
| 6,519,401 | B1 * | 2/2003 | Imamura et al. | 385/123 |
| 6,538,084 | B2 | 3/2003 | Kitahara et al. | |
| 6,586,547 | B1 | 7/2003 | Amin-Sanayei et al. | |
| 6,644,306 | B1 | 11/2003 | Riebe | |
| 6,648,174 | B2 | 11/2003 | Greene | |
| 6,659,977 | B2 | 12/2003 | Kastenhofer | |
| 6,783,673 | B2 | 8/2004 | Horsman et al. | |
| 6,935,540 | B2 | 8/2005 | Ackermann | |
| 6,939,593 | B2 | 9/2005 | Wang | |
| 6,942,648 | B2 | 9/2005 | Schaible et al. | |
| 7,374,812 | B2 | 5/2008 | Mizuno | |
| 7,578,418 | B2 | 8/2009 | Milian | |
| 7,661,563 | B2 | 2/2010 | De Lataulade | |
| 7,718,132 | B2 | 5/2010 | Thomson et al. | |
| 7,722,819 | B2 | 5/2010 | Thomson et al. | |
| 2001/0031330 | A1 | 10/2001 | Ito et al. | |
| 2002/0134451 | A1 | 9/2002 | Blasko et al. | |
| 2003/0211125 | A1 | 11/2003 | Heltovics et al. | |
| 2004/0047826 | A1 | 3/2004 | Brown | |
| 2004/0072704 | A1 | 4/2004 | Gerke et al. | |
| 2004/0142286 | A1 | 7/2004 | French et al. | |
| 2005/0131143 | A1 | 6/2005 | Ugazio | |
| 2005/0189378 | A1 | 9/2005 | Eluck et al. | |
| 2005/0236423 | A1 | 10/2005 | Van Gordon et al. | |
| 2007/0125804 | A1 | 6/2007 | Thomson et al. | |
| 2007/0125805 | A1 | 6/2007 | Thomson et al. | |

FOREIGN PATENT DOCUMENTS

| | | | |
|---|---|---|---|
| EP | 0 839 110 | B1 | 6/1999 |
| FR | 2754788 | A1 * | 4/1998 |
| FR | 2820726 | A1 | 8/2002 |
| JP | S63-139926 | A | 6/1988 |
| JP | 2001-322643 | A | 11/2001 |
| JP | 2004-106932 | A | 4/2004 |
| JP | 3101728 | U | 6/2004 |
| JP | 2004-217728 | A | 8/2004 |
| KR | 10-2001-0041914 | | 5/2001 |
| KR | 10-2004-0029988 | | 4/2004 |
| WO | WO 99/47195 | | 9/1999 |
| WO | WO 02/093261 | | 11/2002 |
| WO | WO 2004/086743 | A2 | 10/2004 |
| WO | WO 2004/105713 | A1 | 12/2004 |
| WO | WO 2007/047168 | A2 | 4/2007 |
| WO | WO 2007/047168 | A3 | 6/2007 |

OTHER PUBLICATIONS

Murthy et al. "Crystallinities of Poly(Chlorotrifluoroethylene) and its Copolymers by Differential Scanning Calorimetry, X-Ray Diffraction, and Density Measurements". 1994. Poly Eng and Sci. vol. 36, pp. 1254-1259.*

PTFE—the Engineering Material with Potential. Berghof.*

Optical Clarity of Fluoropolymers. Zeus Technical Whitepaper.*

Optical Clarity of Fluoropolymers. Zeus Technical Whitepaper (2005).*

PTE—the Engineering Material with Potential. (Date unavailable).*

U.S. Appl. No. 11/374,298, filed Oct. 11, 2005.

Office Action dated Nov. 14, 2008, issued in U.S. Appl. No. 11/374,298.

Office Action dated Aug. 20, 2009, issued in U.S. Appl. No. 11/374,298.

U.S. Appl. No. 11/539,764, filed Oct. 9, 2006.

Office Action dated Nov. 25, 2008, issued in U.S. Appl. No. 11/539,764.

Office Action dated Aug. 20, 2009, issued in U.S. Appl. No. 11/539,764.

U.S. Appl. No. 12/766,538, filed Apr. 23, 2010.

Office Action dated Jan. 20, 2011, issued in U.S. Appl. No. 12/766,528.

U.S. Appl. No. 13/485,735, filed May 31, 2012.

Office Action dated Jul. 9, 2012, issued in U.S. Appl. No. 13/485,735.

English-language translation of FR 2,754,788 A1 (Apr. 24, 1998).

English-language translation of FR 2,820,726 A1 (Aug. 16, 2002).

Plini et al., *Gemology Project: Problem*, May 28, 2004—http://web.archive.org/web/20040528084402/http://www.stanford.edu/dept/sme/eeaacp/problem.html.

Plini et al, *Gemology Project: Solution*, Sep. 3, 2004—http://web.archive.org/web/20040903221046/http://www.stanford.edu/dept/sme/eeaacp/solution.html.

Expedited European Search Report dated Nov. 9, 2006, (related to U.S. Appl. No. 60/725,375).

PCT Search Report and Written Opinion dated Apr. 25, 2007, issued for PCT/US06/39185.

Archive Press Release, *Daikin America, Inc. Introduces EFEP New Melt-Processable Fluoropolymer!*, Jan. 22, 2003—http://news.thomasnet.com/fullstory/18977.

Daikin Industries, Daikin NEOFLON EFEP brochure (Oct. 2003).

Daikin Industries, Technical Information EFEP RP-4020 & 4040 (Jan. 29, 2003).

Dyneon, Dyneon Fluoroplastic Product Comparison Guide (Jun. 2003).

Dyneon, Technical Information Fluorothermoplastic ET 6235 (Jan. 2003).

Dyneon, Technical Information Fluorothermoplastic THVP 2030G X (Sep. 2002).

Zeus Industrial Products, Inc., *Optical Clarity of Fluoropolymers* (2005).

Zeus Industrial Products, Inc., *Zeus Resins—Summary of Properties* (Jun. 2002).

Zeus Industrial Products, Inc., *UV Compatibility* (Jan. 2003).

(56) References Cited

OTHER PUBLICATIONS

Drobny, *Technology of Fluoropolymers* pp. 2-3, 25-27, 32-33, 41, 54, 55, 58, 70, 71, 137-139 (CRC Press 2001).
Drobny, *Technology of Fluoropolymers* (CRC Press 2001).
Unsolicited letter regarding U.S. Appl. Nos. 11/374,298 and 11/539,764 (Oct. 9, 2007).
Unsolicited letter regarding WO 2007/047168 (Jun. 8, 2007).
Unsolicited letter regarding U.S. Appl. Nos. 11/374,298 and 11/539,764 (Dec. 18, 2008).
Concise Polymeric Materials Encyclopedia (J.C. Salomon, ed., 1998) (pp. 323-325).
DuPont, Teflon/Tefzel Extrusion Guide for Melt-Processible Fluoropolymers (Mar. 1993).
I.M. Fouda & F.M. El-Sharkawy, Opto-Thermal Properties of Fibers. XV. A Study of the Drawing Behavior of Quenched POly(ethyleneterephthalates) Fibers, 72 J. Applied Polymer Sci. 1869-1880 (1999).
S. Kojima et al., Influence of Extrusion Ratio on the Thermal Properties and Morphology of Ultradrawn High-Density Polyethylene, 16 J. Polymer Sci. 1721-1728 (1978).
R. Pantani et al., Crystallization Kinetics and PVT Behavior of Poly(vinylidene fluoride) in Process Conditions, 89 J. Applied Polymer Sci. 3396-3403 (2003).
N.S. Murthy, Y.P. Khanna, & A.J. Signorelli, Crystallinities of Poly(Chlorotrifluoroethylene) and Its Copolymers by Differential Scanning Calorimetry, X-Ray Diffraction, and Density Measurements, 36 Polymer Eng'g & Sci. 1254-1259 (Aug. 1994).
R.R. Hegde, M.G. Kamath, & A. Dahiya, Polymer Crystallinity (Sep. 23, 2010) (available at http://web.utk.edu/~mse/Textiles/Polymer%Crystallinity.htm).
G.C. Adams & R.S. Stein, Some Studies of the Crystallization of Polychlorotrifluoroethylene Copolymer Films, 6 J. Polymer Sci. 31-61 (1968).
DuPont, Teflon Fine Powder Processing Guide (Feb. 1991).
DuPont, Teflon Compression Moulding Technical Information (May 1995).
ICI Fluoropolymers, Fluon the Extrusion of PTFE Granular Powders (6th ed. 1992).
A. Larena & G. Pinto, The Effect of Crystallinity on the Light Scattering of Regenerated Cellulose Tubular Films, Polymer Eng'g & Sci. (Jul. 1, 1995) (available at http://www.thefreelibrary.com).
L.A. Ford, Chemical Magic 105-106 (2d ed. 1993).
Machine Translation from Japan IPDL of JP 3101728 U.
Patent Abstracts of Japan, and Machine Translation from Japan IPDL, of JP 2004-106932 A.
PACER Docket for *MeadWestvaco Corporation* v. *Rexam PLC*, E.D. Va. Case No. 1:10cv511 (dated Jul. 30, 2012).
Complaint in *MeadWestvaco Corporation* v. *Rexam PLC*, Case No. 1:10cv511 (E.D. Va. dated May 18, 2010) (with Exhibit A (U.S. Patent No. 7,718,132 B2) and Civil Cover Sheet).
Amended Complaint in *MeadWestvaco Corporation* v. *Rexam PLC*, Case. No. 1:10cv511 (E.D. Va. dated May 25, 2010) (with Exhibit A (U.S. Patent No. 7,718,132 B2) and Exhibit B (U.S. Patent No. 7,722,819 B2)).
Answer, Affirmative Defenses and Counterclaims of Defendants Valois in Response to Plaintiffs' Amended Complaint in *MeadWestvaco Corporation* v. *Rexam PLC*, Case No. 1:10cv511 (E.D. Va. dated Jun. 23, 2010).
Defendant Reexam Beauty and Closures, Inc.'s Answer, Affirmative Defenses and Counterclaims in *MeadWestvaco Corporation* v. *Rexam PLC*, Case. No. 1:10cv511 (E.D. Va. dated Jul. 12, 2010).
Answer to Counterclaims of Valois of America, Inc. in *MeadWestvaco Corporation* v. *Rexam PLC*, Case No. 1:10cv511 (E.D. Va. Jul. 19, 2010).
Answer to Counterclaims of Rexam Beauty and Closures, Inc. in *MeadWestvaco Corporation* v. *Rexam PLC*, Case No. 1:10cv511 (E.D. Va. Aug. 5, 2010).
Second Amended Complaint in *MeadWestvaco Corporation* v. *Rexam PLC*, Case No. 1:10cv511 (E.D. Va. dated Aug. 10, 2010).
Defendant Rexam Beauty and Closures, Inc.'s Answer and Affirmative Defenses to Plaintiffs Second Amended Complaint and Defendant Rexam Beauty and Closures, Inc.'s Amended Counterclaims in *MeadWestvaco Corporation* v. *Rexam PLC*, Case. No. 1:10cv511 (E.D. Va. dated Aug. 18, 2010).
Answer, Affirmative Defenses, and Counterclaims of Defendants Valois in Response to Plaintiffs' Second Amended Complaint in *MeadWestvaco Corporation* v. *Rexam PLC*, Case No. 1:10cv511 (E.D. Va. dated Aug. 24, 2010).
Answer of Counterclaims of Rexam Beauty and Closures, Inc. in *MeadWestvaco Corporation* v. *Rexam PLC*, Case No. 1:10cv511 (E.D. Va. Sep. 7, 2010).
Defendant Rexam Dispensing System SAS's Answer and Affirmative Defenses to Plaintiffs' Second Amended Complaint in *MeadWestvaco Corporation* v. *Rexam PLC*, Case. No. 1:10cv511 (E.D. Va. dated Sep. 10, 2010).
Answer to Valois' Counterclaims in Response to Plaintiffs' Second Amended Complaint in *MeadWestvaco Corporation* v. *Rexam PLC*, Case. No. 1:10cv511 (E.D. Va. dated Sep. 14, 2010).
First Amended Answer, Affirmative Defenses, and Counterclaims of Defendants Valois in Response to Plaintiffs' Second Amended Complaint in *MeadWestvaco Corporation* v. *Rexam PLC*, Case. No. 1:10cv511 (E.D. Va. dated Dec. 13, 2010).
Plaintiffs' Answer to Valois' First Amended Counterclaims in Responses to Plaintiff's Second Amended Complaint in *MeadWestvaco Corporation* v. *Rexam PLC*, Case No. 1:10cv511 (E.D. Va. Dec. 30, 2010).
Joint Claim Construction Statement in *MeadWestvaco Corporation* v. *Rexam PLC*, Case No. 1:10cv511 (E.D. Va. Feb. 9, 2011).
Supplemental Joint Claim Construction Statement in *MeadWestvaco Corporation* v. *Rexam PLC*, Case No. 1:10cv511 (E.D. Va. Feb. 14, 2011).
Motion for Partial Summary Judgment by Plaintiffs in *MeadWestvaco Corporation* v. *Rexam PLC*, Case No. 1:10cv511 (E.D. Va. Jun. 15, 2011).
Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011).
"Cosmetic/Personal Care Packaging, 2007 FiFi Awards Outstanding Packages," from Cosmetic & Personal Care Packaging Magazine 2008 (Exhibit R to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).
2007 Starpack Silver Awards (Exhibit S to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).
Oscar de l'Emballage 2007 (Exhibit T to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).
"Creativity and Innovation to the Fore at Luxe Pack Brasil" (Exhibit U to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)) (with Certified English Translation).
"New: Absolute Transparance . . . from leader REXAM" (Exhibit V to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).
Rexam, "The Invisible Dip Tube" (Exhibit W to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).
"Ultimate Valois" (Exhibit X to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).

(56) References Cited

OTHER PUBLICATIONS

Rexam, "Rexam Supplies Pump & Cap Components for Three FiFi Awards Winners" (Jun. 23, 2006) (Exhibit Z to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).
Sina Ebnesajjad, "Fluoroplastics vols. 2: Melt Processible Fluoropolymers the Definite User's Guide and Databook" 211 (2003) (Exhibit AA to Brief in Support of Plaintiffs' Motion for Partial Summary Judgment of Patent Validity and Enforceability (Redacted Public Version) in *MeadWestvaco Corporation* v. *Rexam PLC*, Case No. 1:10cv511 (E.D. Va. Jun. 15, 2011)).
Rexam's Motion for Summary Judgment of Invalidity under 35 U.S.C. § 112, ¶ 2 in *MeadWestvaco Corporation* v. *Rexam PLC*, Case No. 1:10cv511 (E.D. Va. Jun. 15, 2011).
Memorandum of Law in Support of Rexam's Motion for Summary Judgment of Invalidity under 35 U.S.C. §112 in *MeadWestvaco Corporation* v. *Rexam PLC*, Case No. 1:10cv511 (E.D. Va. Jun. 15, 2011).
Initial Infringement Expert Report of Joseph H. Reibenspies, Ph.D. (Exhibit 3 to Memorandum of Law in Support of Rexam's Motion for Summary Judgment of Invalidity under 35 U.S.C. §112 in *MeadWestvaco Corporation* v. *Rexam PLC*, Case No. 1:10cv511 (E.D. Va. Jun. 15, 2011)).
Expert Report of Dr. Richard B. Ortega (Exhibit 4 to Memorandum of Law in Support of Rexam's Motion for Summary Judgment of Invalidity under 35 U.S.C. §112 in *MeadWestvaco Corporation* v. *Rexam PLC*, Case No. 1:10cv511 (E.D. Va. Jun. 15, 2011)).
Expert Report of Thomas P. Russell, Ph.D. Relating to XRD Crystallinity Testing (Exhibit 5 to Memorandum of Law in Support of Rexam's Motion for Summary Judgment of Invalidity under 35 U.S.C. §112 in *MeadWestvaco Corporation* v. *Rexam PLC*, Case No. 1:10cv511 (E.D. Va. Jun. 15, 2011)).
Transcript from Jun. 9, 2011, Deposition of Joseph H. Reibenspies, Ph.D. (Exhibit 6 to Memorandum of Law in Support of Rexam's Motion for Summary Judgment of Invalidity under 35 U.S.C. §112 in *MeadWestvaco Corporation* v. *Rexam PLC*, Case No. 1:10cv511 (E.D. Va. Jun. 15, 2011)).
Bruker Advanced X-Ray Solutions, "General Area Detector Diffraction System (GADDS) Version 4.0 Software Reference Manual" (1999) (Exhibit 8 to Memorandum of Law in Support of Rexam's Motion for Summary Judgment of Invalidity under 35 U.S.C. §112 in *MeadWestvaco Corporation* v. *Rexam PLC*, Case No. 1:10cv511 (E.D. Va. Jun. 15, 2011)).
Defendants Valois' Memorandum in Opposition to MWV's Motion for Partial Summary Judgment (Filed Under Seal) in *MeadWestvaco Corporation* v. *Rexam PLC*, Case No. 1:10cv511 (E.D. Va. Jun. 27, 2011).
Daikin Presentation "Not All Fluoropolymer Companies Are Created Equal" (Sep. 29, 2003) (Exhibit 19 in Defendants Valois' Memorandum in Opposition to MWV's Motion for Partial Summary Judgment (Filed Under Seal) in *MeadWestvaco Corporation* v. *Rexam PLC*, Case No. 1:10cv511 (E.D. Va. Jun. 27, 2011)).
Rexam's Memorandum of Law in Opposition to Plaintiff's Motion for Partial Summary Judgment of Patent Validity and Enforceability (Filed Under Seal) in *MeadWestvaco Corporation* v. *Rexam PLC*, Case No. 1:10cv511 (E.D. Va. Jun. 27, 2011).
Sina Ebnesajjad, "Fluoroplastics vols. 2: Melt Processible Fluoropolymers The Definite User's Guide and Databook" 69, 195-221 (2003) (Exhibit 19 to Rexam's Memorandum of Law in Opposition to Plaintiff's Motion for Partial Summary Judgment of Patent Validity and Enforceability (Filed Under Seal) in *MeadWestvaco Corporation* v. *Rexam PLC*, Case No. 1:10cv511 (E.D. Va. Jun. 27, 2011)).
Plaintiffs' Brief in Opposition to Rexam's Motion for Summary Judgment of Invalidity under 35 U.S.C. § 112, ¶ 2 (Redacted Public Version) in *MeadWestvaco Corporation* v. *Rexam PLC*, Case No. 1:10cv511 (E.D. Va. Jun. 27, 2011).
Plaintiffs' Reply Brief in Support of Their Motion for Partial Summary Judgment of Patent Validity and Enforceability (Filed Under Seal) in *MeadWestvaco Corporation* v. *Rexam PLC*, Case No. 1:10cv511 (E.D. Va. Jun. 29, 2011).
Reply Brief in Support of Rexam's Motion for Summary Judgment of Invalidity Under 35 U.S.C. § 112 in *MeadWestvaco Corporation* v. *Rexam PLC*, Case No. 1:10cv511 (E.D. Va. Jun. 29, 2011).
Order regarding Summary Judgment Motions in *MeadWestvaco Corporation* v. *Rexam PLC*, Case No. 1:10cv511 (E.D. Va. Aug. 15, 2011).
Claim Construction Memorandum Opinion and Order in *MeadWestvaco Corporation* v. *Rexam PLC*, Case No. 1:10cv511 (E.D. Va. Aug. 17, 2011).
Memorandum Opinion and Order regarding Summary Judgment Motions in *MeadWestvaco Corporation* v. *Rexam PLC*, Case No. 1:10cv511 (E.D. Va. Aug. 18, 2011).
Sep. 7, 2011, AM Trial Transcript in *MeadWestvaco Corporation* v. *Rexam PLC*, Case No. 1:10cv511 (E.D. Va.).
Sep. 7, 2011, PM Trial Transcript in *MeadWestvaco Corporation* v. *Rexam PLC*, Case No. 1:10cv511 (E.D. Va.).
Sep. 8, 2011, AM Trial Transcript in *MeadWestvaco Corporation* v. *Rexam PLC*, Case No. 1:10cv511 (E.D. Va.).
Sep. 8, 2011, PM Trial Transcript in *MeadWestvaco Corporation* v. *Rexam PLC*, Case No. 1:10cv511 (E.D. Va.).
Sep. 12, 2011, AM Trial Transcript in *MeadWestvaco Corporation* v. *Rexam PLC*, Case No. 1:10cv511 (E.D. Va.).
Sep. 12, 2011, PM Trial Transcript in *MeadWestvaco Corporation* v. *Rexam PLC*, Case No. 1:10cv511 (E.D. Va.).
Sep. 13, 2011, AM Trial Transcript in *MeadWestvaco Corporation* v. *Rexam PLC*, Case No. 1:10cv511 (E.D. Va.).
Sep. 13, 2011, PM Trial Transcript in *MeadWestvaco Corporation* v. *Rexam PLC*, Case No. 1:10cv511 (E.D. Va.).
Sep. 14, 2011, AM Trial Transcript in *MeadWestvaco Corporation* v. *Rexam PLC*, Case No. 1:10cv511 (E.D. Va.).
Sep. 14, 2011, PM Trial Transcript in *MeadWestvaco Corporation* v. *Rexam PLC*, Case No. 1:10cv511 (E.D. Va.).
Sep. 15, 2011, AM Trial Transcript in *MeadWestvaco Corporation* v. *Rexam PLC*, Case No. 1:10cv511 (E.D. Va.).
Sep. 15, 2011, PM Trial Transcript in *MeadWestvaco Corporation* v. *Rexam PLC*, Case No. 1:10cv511 (E.D. Va.).
Sep. 19, 2011, AM Trial Transcript in *MeadWestvaco Corporation* v. *Rexam PLC*, Case No. 1:10cv511 (E.D. Va.).
Sep. 19, 2011, PM Trial Transcript in *MeadWestvaco Corporation* v. *Rexam PLC*, Case No. 1:10cv511 (E.D. Va.).
Sep. 20, 2011, AM Trial Transcript in *MeadWestvaco Corporation* v. *Rexam PLC*, Case No. 1:10cv511 (E.D. Va.).
Sep. 20, 2011, PM Trial Transcript in *MeadWestvaco Corporation* v. *Rexam PLC*, Case No. 1:10cv511 (E.D. Va.).
Sep. 21, 2011, AM Trial Transcript in *MeadWestvaco Corporation* v. *Rexam PLC*, Case No. 1:10cv511 (E.D. Va.).
Sep. 21, 2011, PM Trial Transcript in *MeadWestvaco Corporation* v. *Rexam PLC*, Case No. 1:10cv511 (E.D. Va.).
Sep. 22, 2011, AM Trial Transcript in *MeadWestvaco Corporation* v. *Rexam PLC*, Case No. 1:10cv511 (E.D. Va.).
Sep. 22, 2011, PM Trial Transcript in *MeadWestvaco Corporation* v. *Rexam PLC*, Case No. 1:10cv511 (E.D. Va.).
Sep. 26, 2011, AM Trial Transcript in *MeadWestvaco Corporation* v. *Rexam PLC*, Case No. 1:10cv511 (E.D. Va.).
Sep. 26, 2011, PM Trial Transcript in *MeadWestvaco Corporation* v. *Rexam PLC*, Case No. 1:10cv511 (E.D. Va.).
Sep. 27, 2011, AM Trial Transcript in *MeadWestvaco Corporation* v. *Rexam PLC*, Case No. 1:10cv511 (E.D. Va.).
Sep. 27, 2011, PM Trial Transcript in *MeadWestvaco Corporation* v. *Rexam PLC*, Case No. 1:10cv511 (E.D. Va.).
Sep. 28, 2011, AM Trial Transcript in *MeadWestvaco Corporation* v. *Rexam PLC*, Case No. 1:10cv511 (E.D. Va.).
Sep. 28, 2011, PM Trial Transcript in *MeadWestvaco Corporation* v. *Rexam PLC*, Case No. 1:10cv511 (E.D. Va.).
Memorandum Opinion after Trial (Redacted) in *MeadWestvaco Corporation* v. *Rexam PLC*, Case No. 1:10cv511 (E.D. Va. Apr. 12, 2012).

(56) References Cited

OTHER PUBLICATIONS

Memorandum Opinion regarding Permanent Injunction in *MeadWestvaco Corporation* v. *Rexam PLC*, Case No. 1:10cv511 (E.D. Va. Jun. 12, 2012).
Order regarding Permanent Injunction Against Defendant Rexam Beauty and Closures, Inc. in *MeadWestvaco Corporation* v. *Rexam PLC*, Case No. 1:10cv511 (E.D. Va. Jun. 12, 2012).
Order regarding Permanent Injunction Against Defendant Valois of America, Inc. in *MeadWestvaco Corporation* v. *Rexam PLC*, Case No. 1:10cv511 (E.D. Va. Jun. 12, 2012).
Notice of Appeal by Valois of America, Inc. in *MeadWestvaco Corporation* v. *Rexam PLC*, Case No. 1:10cv511 (E.D. Va. Jul. 6, 2012).
Defendant Rexam Beauty and Closures, Inc.'s and Rexam Dispensing Systems SAS's Notice of Appeal to the Federal Circuit in *MeadWestvaco Corporation* v. *Rexam PLC*, Case No. 1:10cv511 (E.D. Va. Jul. 11, 2012).
Plaintiff's Notice of Appeal in *MeadWestvaco Corporation* v. *Rexam PLC*, Case No. 1:10cv511 (E.D. Va. Jul. 12, 2012).
PACER Docket for *MeadWestvaco Corporation* v. *Rexam Beauty*, Fed. Cir. Case No. 12-1518 (dated Aug. 1, 2012).
PACER Docket for *MeadWestvaco Corporation* v. *Rexam Beauty*, Fed. Cir. Case No. 12-1527 (dated Aug. 1, 2012).
PACER Docket for *MeadWestvaco Corporation* v. *Rexam Beauty*, Fed. Cir. Case No. 12-1528 (dated Aug. 1, 2012).
Technical Information—Ethylene-Tetrafluoroethylene Copolymer (ETFE), available at www.goodfellow.com (Nov. 2012).
Order Granting Inter Partes Reexamination of U.S. Patent No. 7,718,132 in Control No. 95/002,215 (Nov. 13, 2012).
Office Action in Inter Partes Reexamination of U.S. Patent No. 7,718,132 in Control No. 95/002,215 (Nov. 13, 2012).
Order Granting Inter Partes Reexamination of U.S. Patent No. 7,722,819 in Control No. 95/002,212 (Nov. 13, 2012).
Office Action in Inter Partes Reexamination of U.S. Patent No. 7,722,819 in Control No. 95/002,212 (Nov. 13, 2012).
Non-Confidential Corrected Brief of Plaintiffs-Appellees filed in *MeadWestvaco Corporation* v. *Rexam Beauty*, Case Nos. 2012-1518, 2012-1527 (Fed. Cir. Mar. 28, 2013).
Corrected Non-Confidential Reply Brief of Defendant-Appellant Valois of America, Inc. in *MeadWestvaco Corporation* v. *Rexam Beauty*, Appeal Nos. 2012-1518, 2012-1527 (Fed. Cir. Apr. 30, 2013).
Reply Brief of Defendants-Appellants Rexam Beauty and Closures, Inc. and Rexam Dispensing Systems S.A.S. in *MeadWestvaco Corporation* v. *Rexam Beauty*, Appeal Nos. 2012-1518, 2012-1527 (Fed. Cir. Apr. 29, 2013).
Anonymous Third-Party Observation filed Sep. 25, 2013, in related European Patent Application No. 06836214.4.
Decision of the U.S. Court of Appeals for the Federal Circuit in *MeadWestvaco Corporation* v. *Rexam Beauty*, Case Nos. 2012-1518, 2012-1527 (Fed. Cir. Sep. 26, 2013).
Petition under 37 C.F.R § 1.927, or, in the Alternative, 37 C.F.R. § 1.183 filed Dec. 5, 2012, in Inter Partes Reexamination Control No. 95/002,215.
Patent Owner Response to Third Party Requester's Petition under 37 C.F.R. § 1.927 or, in the Alternative, 37 C.F.R. § 1.183 filed Jan. 13, 2013, in Inter Partes Reexamination Control No. 95/002,215.
Decision on Petition mailed Jun. 28, 2013, in Inter Partes Reexamination Control No. 95/002,215.
Action Closing Prosecution mailed Sep. 16, 2013, in Inter Partes Reexamination Control No. 95/002,215.
Petition under 37 C.F.R § 1.927, or, in the Alternative, 37 C.F.R. § 1.183 filed Dec. 5, 2012, in Inter Partes Reexamination Control No. 95/002,212.
Patent Owner Response to Third Party Requester's Petition under 37 C.F.R. § 1.927 or, in the Alternative, 37 C.F.R. § 1.183 filed Jan. 13, 2013, in Inter Partes Reexamination Control No. 95/002,212.
Decision on Petition mailed Jun. 28, 2013, in Inter Partes Reexamination Control No. 95/002,212.
Action Closing Prosecution mailed Sep. 16, 2013, in Inter Partes Reexamination Control No. 95/002,212.
Non-Final Office Action dated Jul. 9, 2013, in U.S. Appl. No. 13/485,735.
Ebnesajjad, "Fluoroplastics," vol. 2: Melt Processible Fluoropolymers, The Definitive User's Guide and Databook, 69 & 196-221 (2003).
Slides from a presentation by Mr. Pierre Kuyl of Daikin Industries, Inc., dated Oct. 2, 2002, regarding Daikin EFEP and related deposition testimony of Mr. Pierre Kuyl taken in *MeadWestvaco Corporation* v. *Rexam PLC*, Case No. 1:10cv511 (E.D. Va. read at trial on Sep. 27, 2011) ("Daikin 2002/Kuyl").
Slides from a presentation by Daikin Industries, Inc. to Markel, dated Sep. 29, 2003 (pages identified by MARKEL00872-890) regarding Daikin EFEP and related deposition testimony of Charles Marino of Markel Corporation, taken in *MeadWestvaco Corporation* v. *Rexam PLC*, Case No. 1:10cv511 (E.D. Va. Apr. 14, 2011) (pp. 1, 3, 8, 9, 24-26, & 38-39) ("Daikin 2003/Marino").
Control No. 95/002,215 (Inter Partes Reexamination of U.S. Patent No. 7,718,132), (Nov. 9, 2006).
Third-Party Request for Inter Partes Reexamination of U.S. Patent No. 7,718,132 filed Sep. 13, 2012, by Hugh Abrams of Sidley Austin LLP for Real-Party-in-Interest AptarGroup, Inc.
Control No. 95/002,212 (Inter Partes Reexamination of U.S. Patent No. 7,722,819), (Nov. 11, 2005).
Third-Party Request for Inter Partes Reexamination of U.S. Patent No. 7,722,819 filed Sep. 13, 2012, by Hugh Abrams of Sidley Austin LLP for Real-Party-in-Interest AptarGroup, Inc.
U.S. Appl. No. 60/675,890, filed Apr. 29, 2005 (related to U.S. Patent No. 7,661,563).
Right of Appeal Notice dated Feb. 28, 2013, in Inter Partes Reexamination Control No. 95/002,212.
Right of Appeal Notice dated Feb. 28, 2013, in Inter Partes Reexamination Control No. 95/002,215.
Stipulation of Dismissal with Prejudice in *MeadWestvaco Corporation* v. *Rexam PLC*, C.A. No. 1:10-cv-511-GBL-TRJ (E.D. Va. Feb. 19, 2014).
Stipulation of Dismissal with Prejudice in *MeadWestvaco Corporation* v. *Rexam PLC*, C.A. No. 1:10-cv-511-GBL-TRJ (E.D. Va. Mar. 4, 2014).

* cited by examiner

FRAGRANCE PRODUCT, DISPENSER, AND DISPENSER ASSEMBLY

CROSS-REFERENCE TO RELATED APPLICATION(S)

This application is a continuation application of, and also claims the benefit of priority from, U.S. patent application Ser. No. 12/766,538 filed Apr. 23, 2010, now abandoned which is a continuation of U.S. patent application Ser. No. 11/374,298 (converted from U.S. Provisional Patent Application No. 60/725,375) (now U.S. Pat. No. 7,722,819 issued May 25, 2010), filed Oct. 11, 2005, both of which are incorporated by reference herein in their entireties.

BACKGROUND

1. Field of the Disclosure

In many industries, product marketing can be a challenging and complex process, and despite the underlying virtues of a product, marketing approaches continue to play a significant role in product success and ultimately the success of the vendor. Particularly, in modish industries, such as fashion apparel, fashion accessories, cosmetics, fragrances and other personal beauty products, the marketability of a product is determined in a large part by aesthetically pleasing product packaging and presentation. As such, the ability to develop and present a product in a unique and desirable manner is of the highest priority for vendors of modish products.

2. Description of the Related Art

In the context of personal beauty products, a consumer may be more likely to purchase a product packaged in an aesthetically pleasing manner. Consequently, manufactures have developed techniques to conceal or obscure non-decorative and functional packaging components. Such techniques include the use of creative designs and colors on the exterior of containers. Other manufacturers have provided such decorations on both interior and exterior packaging parts to conceal components of the packaging or of the product itself. In the particular context of fragrance products, dispensing mechanisms represent a notable aesthetic challenge.

Accordingly, in view of the foregoing, there is a continuous need in the industry for improvements in product packaging. Moreover, manufacturers continue to demand new and unique techniques related to product design and packaging in order to gain a competitive edge.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
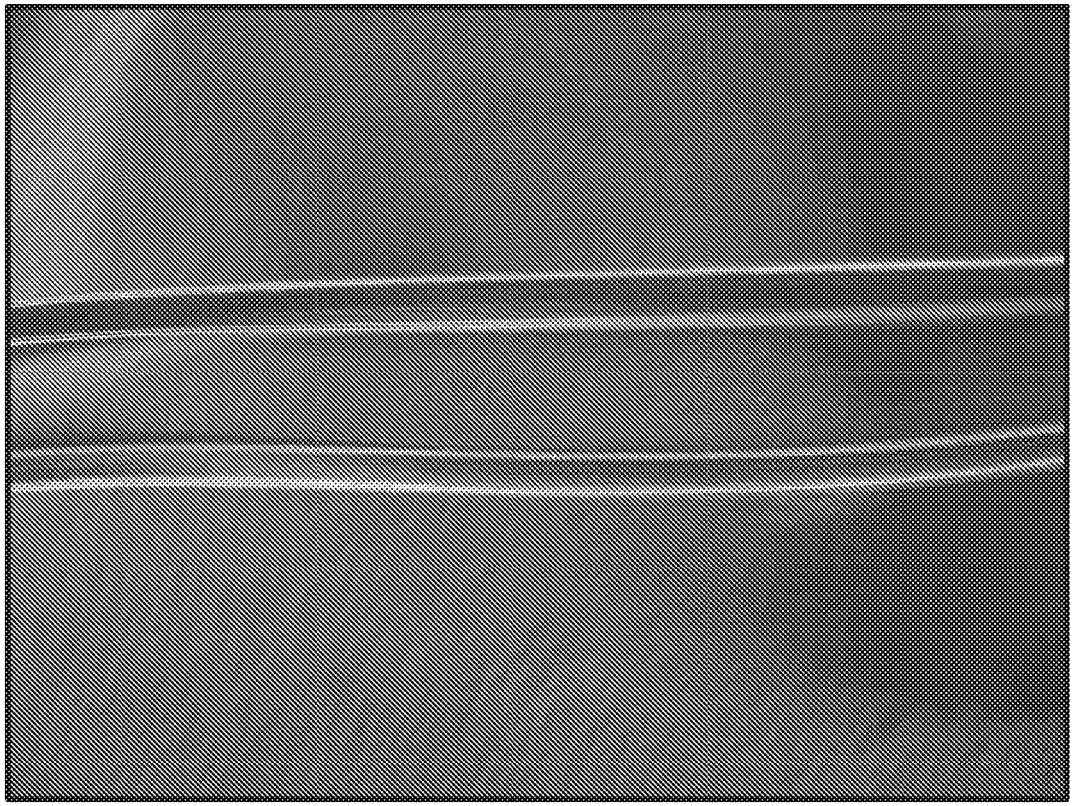
FIG. 1 is an illustration of a system including a tube immersed in and containing a liquid fragrance, the liquid fragrance product and tube having an index of refraction difference of 0.10.

According to one embodiment, a fragrance product comprises a container containing a liquid fragrance and a dispenser assembly for dispensing the liquid fragrance, wherein the dispenser assembly includes a transport assembly and a tube extending into the liquid fragrance and connected to the transport assembly. According to this embodiment, the tube and the liquid fragrance each have a refractive index and the difference (absolute value) between the refractive index of the tube and the liquid fragrance is not greater than about 0.04.

According to one embodiment, the container is substantially transparent. A variety of degrees of transparency are suitable, as it will be appreciated that the transparency of the container is a function of packaging and customer appeal. While opaque fragrance product containers have been utilized in the industry, typically the present container is at least translucent or, more typically, substantially transparent. Use of substantially transparent containers herein may facilitate the viewing of the liquid fragrance and provide a sense of clarity and assurance to the consumer in the purchased product. Most often, the substantially transparent container has a tint or color, generally a tint or color that is not native to the material of the container, which is generally a glass such as a silica-based glass.

Referring to the liquid fragrance within the container, as used herein, the term "fragrance" is used to define a substance that is applied to a person and which diffuses an aroma for its aesthetic and/or functional qualities. According to an embodiment, the liquid fragrance comprises at least one of a base note, middle note, and a top note. The term "note" can refer to a single scent of a perfume or it can refer to the degree of volatility of certain fragrant compounds. Accordingly, compositions categorized as top notes have the highest degree of volatility and therefore the fragrance is brief. Depending upon the manufacturer, a fragrant compound of the top note variety typically lasts only a few minutes and is described as an assertive or sharp scent. Compositions categorized as middle notes (also referred to as heart notes) have a moderate volatility and emerge after the top note evaporates. A middle note, appears anywhere from about 10 minutes to an hour after the initial application. A base note composition has the most long lasting fragrance and is a rich or deep scent, generally appearing about 30 minutes to an hour after the initial application. According to one embodiment, the fragrance contains compositions of more than one note, which is referred to as an accord or a combination of scents that derive a different and distinct scent. In another embodiment, the fragrance contains a mixture of all three notes.

According to another embodiment, the liquid fragrance is categorized as a perfume extract, perfume, eau de toilette, eau de cologne, or aftershave. The distinction between these categorizations of personal fragrance compositions indicates the percentage of aromatic compounds present in the fragrance. As used herein, a perfume extract contains about 20-40% aromatic compounds while an eau de parfum contains about 10-20% aromatic compounds. An eau de toilette contains about 5-10% aromatic compounds and an eau de cologne contains about 2-3% aromatic compounds, while an aftershave contains about 1-3% aromatic compounds. It is noted that while these values may differ among manufacturers, however the hierarchy of the categorization is consistent among manufacturers. Regardless of the differences in percentages between manufacturers, the present liquid fragrance is suitable as any fragrance composition independent of the distinct percentage of aromatic compounds present. Embodiments of the present disclosure are particularly directed to perfume extracts, eau de parfum, and eau de toilettes, and even more particularly perfume extracts and eau de parfum.

In further reference to the liquid fragrance, according to another embodiment, the liquid fragrance generally comprises a carrier compound. As indicated by the name, a carrier compound serves to dilute and carry the aromatic compound and a suitable carrier compound includes either an oil or alcohol. As such, suitable carrier oils include naturally-occuring compounds such as those oils from nuts and seeds. For example, common carrier oils are extracted from soybean, sweet almond, aloe, apricot, grape seed, calendula, olive oil, jojoba, peach kernel and combinations thereof. The carrier compounds may also use an alcohol-based compound, including for example, ethanol, isopropyl, phenol, glycerol or a group of alcohols more commonly referred to as fatty alcohols and combinations thereof.

According to another embodiment, the liquid fragrance also includes an aromatic compound. In one embodiment the aromatic compound is a naturally occurring organic compound, such as an essential oil or a combination of essential oils. Generally, essential oils are a broad class of volatile oils, extracted from plants, fruits, or flowers having a characteristic odor. Generally, the essential oils derive their characteristic odor from one of two basic organic building blocks present within the composition, those being an isoprene unit or a benzene ring. Yet, the aromatic compounds may come from another class of naturally occurring organic compounds, such as an animal-based extract. Alternatively, the aromatic compounds may be synthetically formed to imitate the smell or even reproduce the chemical constituents, and therefore the characteristic odor of the naturally occurring organic compounds. According to another embodiment, the aromatic compound may be synthetically formed to produce a unique smell that is not reproduced by a naturally occurring organic compound.

Independent of the nature of the compound, be it natural or synthetic, the aromatic compounds derive distinct scents from an aromatic functional group. Typically, the aromatic functional groups are formed by a chemical combination of the isoprene unit or benzene ring building blocks discussed above. As such, suitable aromatic functional groups include alcohols, ethers, aldehydes, keytones, esters, lactones, castor oil products, nitrites, terpenes, paraffins, and heterocyles, or combinations thereof. Generally, one aromatic functional group produces one aroma, however a liquid fragrance, can contain a mixture of aromatic compounds and aromas, as discussed previously in conjunction with the base, middle and top notes. Accordingly a liquid fragrance product can contain one or more aromatic compounds with one or more aromatic functional groups.

The liquid fragrance product may further include a fixative, such as a material for binding various aromatic compounds and making the fragrance last for longer durations. A suitable fixative can include naturally occurring materials such as balsams, angelica, calamus, orris, or alternatively an animal-based extract such as ambergris, civet, castoreum or musk. Alternatively, fixatives can be synthesized materials containing derivatives of or equivalents to naturally occurring materials or other materials such as phtalates or glycerin.

Generally, the liquid fragrance has an index of refraction less than about 1.50 such as within a range of between about 1.32 and 1.45. In one embodiment, the liquid fragrance has an index of refraction within a range of between about 1.35 and 1.42, such as in a range of between about 1.36 and 1.40. Still other embodiments have a liquid fragrance with an index of refraction within a range of between about 1.37 and 1.39.

Referring to the dispenser assembly, the dispenser assembly generally includes a mechanism for dispensing the liquid fragrance, for instance, a transport assembly. According to one embodiment, the transport assembly includes a pump for transferring the liquid fragrance product from the interior of the container to the exterior, for application to a person. Generally, the pump uses a pressure differential activated by a variety of mechanisms, such as a button, trigger or bulb actuated by the consumer. According to another embodiment, the transport assembly includes a pneumatic assembly. In a particular embodiment, the liquid fragrance is a perfume and the transport mechanism is a pneumatic assembly to enable perfume delivery in a mist to the consumer in order to effectively disperse the scent, such as over a broad area of the body, thereby providing a larger area of evaporation for the perfume. Accordingly, in one embodiment, the transport assembly includes a sprayer or atomizer, for delivery of the liquid fragrance in a mist.

Referring to the tube, the tube provides a reservoir for transporting the liquid fragrance product from the container, through the transport assembly, to the consumer. The tube extends into the liquid fragrance and by capillary action the liquid fragrance fills the tube to a particular level. In one embodiment, the tube is a plastic material, notably a fluoropolymer. According to one embodiment, the tube can be comprised of a fluoropolymer material such as polytetrafluoroethylene (PTFE), tetrafluoroethylene and perfluoroalkyl vinyl ether (PFA), tetrafluoroethylene and hexafluoropropylene (FEP), tetrafluoroethylene and ethylene (ETFE), polyvinylidene fluoride (PVDF), polycholorotrifluoroethylene (PCTFE), ethylene tetrafluoroethylene (EFEP), modified ethylene tetrafluoroethylene, polyfluoroacrylates, polytrifluoroacetate, tetrafluroethylene and hexafluoropropylene and vinylidene fluoride (THV), and combinations thereof. Of the foregoing, ethylene tetrafluoroethylene (EFEP), tetrafluoroethylene and ethylene (ETFE), and the combined materials of tetrafluoroethylene and hexafluoropropylene (FEP), and combinations thereof are particularly suitable tube materials.

In further reference to the tube, according to one embodiment, the tube is made from a material having an index of refraction not greater than about 1.50. According to another embodiment, the tube can have an index of refraction not greater than about 1.45, 1.43, 1.40 or even not greater than about 1.38.

In further reference to the tube, a material having a suitable transparency facilitates a desirable, low visibility optical effect of the tube when immersed in and containing a liquid fragrance. According to one embodiment, the tube is made of a material having a transparency not less than about 80%, based on percent transmission of a light having a wavelength of 500 microns passing through a 3mm thick sample. In other embodiments, the tube is made of material having a transparency not less than about 85% or even 88%. Still, in other embodiments, the tube is made of a material having a greater transparency, such that the transparency is not less than about 90% or even about 92%.

According to one embodiment, the tube is hollow, thin-walled and has a fine geometry, having an ID (inside diameter) within a range of about 0.1 mm to about 3.0 mm, such as 0.1 to about 2.0 mm, or 0.1 to about 1.0 mm. A particular sample had an ID of 0.95 mm. OD (outside diameter) is generally within a range of about 0.25 to 10.0 mm, such as 0.5 to 5.0 mm, or 0.5 to 3.0 mm. A particular OD was 1.65 mm. Generally, the tube has a uniform wall thickness, within a range of about 0.05 mm to about 3.0 mm, such as 0.1 mm to 1.0 mm, and most often within a range of about of 0.1 mm to 0.75 mm. A particular wall thickness was 0.35 to 0.38 mm.

In regards to the tube, formation of the tube from a material having a suitable degree of crystallinity facilitates the low visibility optical effect of the tube immersed in and containing the liquid fragrance. According to one embodiment, the crystallinity of the material comprising the tube is not greater than about 13%, such as not greater than about 11%. Typically, crystallinity is not greater than 10%, such as not greater than 8%. Indeed, certain embodiments were found to have a crystallinity not greater than about 6%. Noteworthy, the above crystallinity values were measured based on X-Ray Diffraction (XRD). It is noted that other crystallinity measurement techniques such as Differential Scanning calorimetry (DSC) may provide different crystallinity data; however, crystalline contents specified herein are strictly quantified by XRD. The particular XRD characterization parameters are as follows:

Voltage: 45 kV, Current:40 mA, XRD Machine: Bruker D8 Discover w/ Gadds Detector, 0.3 mm slit, 0.3 mm collimation, Cu Radiation, Goebel Mirror (parallel beams), 0.5 mm oscillation along tube length, 5 frames (~15° /frame), 72 seconds/frame, Omega=7°, midpoint for detection frames=14°, 29°, 44°, 59°, 74°.

According to a particular feature, embodiments may be produced utilizing a quenching sequence that facilitates creation of high transparency and/or low crystallinity tubes, which may take on particular significance in the context of fine dimension, thin-walled tubes as described above. In one example, EFE-4040 (modified ethylene tetrafluoroethylene) was extruded under the following conditions: Melt temperature: 520° F. to 540° F., line speed: 100 to 125 fpm, quench tank temperature: 80° F. to 90° F., distance between extruder die and quench tank: 1" to form a 1.65 mm OD, 0.95 mm ID tube. Further testing revealed that quenching was important to ensure high transparency and/or low crystallinity. Non-quenched samples of the same material were found to have crystalline contents of 18% (lhr anneal at 155° C.), 13% (5hr anneal at 155° C.), and higher (e.g., 29% and 33%). Such comparative samples were also found to be hazy, not achieving high transparency. It is contemplated that fine dimensional tubes may assist in achieving a generally uniform temperature profile through the thickness of the tube, further enhancing transparency and/or suppressing XRD crystallinity.

According to a particular feature, the difference in refractive indices between the tube and the liquid fragrance is not greater than about 0.040, such as not greater than about 0.035 when the tube is immersed in and contains the liquid fragrance. As used herein, the term "delta" or "difference" in refractive indices is the absolute value of the refractive index of the liquid fragrance subtracted from the refractive index of the material comprising the tube. In certain embodiments, the delta of such systems having a tube immersed in and containing the liquid fragrance is not greater than about 0.030, such as not greater than about 0.027 or 0.025. In some embodiments, the refractive index delta may be less, such as not greater than about 0.020, or 0.010. Indeed, the refractive indices may be the same (zero delta).

The refractive features according to embodiments herein are of particular significance. The state of the art has developed container assemblies for storage, transport, and dispensing of fluids having structured components that have an index of refraction approximately that of the fluid. For example, U.S. Pat. No. 6,276,566 describes a technique to mount a three-dimensional design within a container to obscure the functional components of the dispensing container. The disclosed delivery tube and liquid product (typically liquid soaps, shampoos, lotions, oils and beverages), have indices of refraction within about 0.50 of each other, preferably within about 0.25 of each other. While in perhaps some applications, an index of refraction spread of that order of magnitude can achieve low visibility (concealment) delivery tubes, it has been discovered that particularly in the context of liquid fragrance products, desired concealment or low visibility of structured components requires more closely matched indices of refraction. Further details are provided below in connection with the drawings.

In addition, attention is drawn to the use of fluoropolymers as described above. It has been discovered that certain fluoropolymers, such as ethylene tetrafluoroethylene (EFEP), tetrafluoroethylene and ethylene (ETFE) and tetrafluoroethylene and hexafluoropropylene (FEP) are particularly useful in carrying out embodiments of the present invention. In this respect, such fluoropolymers have generally not been utilized in fragrance products, believed to be due in large part to high crystalline content which is particularly undesirable in obtaining target tube transparency levels. In contrast, embodiments herein utilize controlled crystalline content materials, and materials having transparency values as described above. Still further, embodiments herein that take advantage of certain fluoropolymers desirably have an index of refraction as noted above (most often not greater than 1.45, 1.43, 1.40, or even not greater than about 1.38), which is particularly notable. That is, common polymers as utilized in the prior art generally have an index of refraction within a range of about 1.4668 to about 1.5894. Such polymers generally cannot meet the concealment requirements in the context of fragrance products.

The low visibility optical effect of the tube immersed in and containing a fluid is illustrated in the accompanying Figures. FIG. 1 is an illustration of a tube immersed in and containing a liquid fragrance, wherein the difference between the refractive index of the tube and the liquid fragrance is about 0.10. Here the liquid fragrance is a perfume having an index of refraction of 1.37, while the tube has an index of refraction of 1.47. The tube is formed of polymethylpentene (PMP). As illustrated in FIG. 1 the features of the tube, namely the edges of inner wall and the outer wall, are distinctly visible within the fluid.

Figure 2:
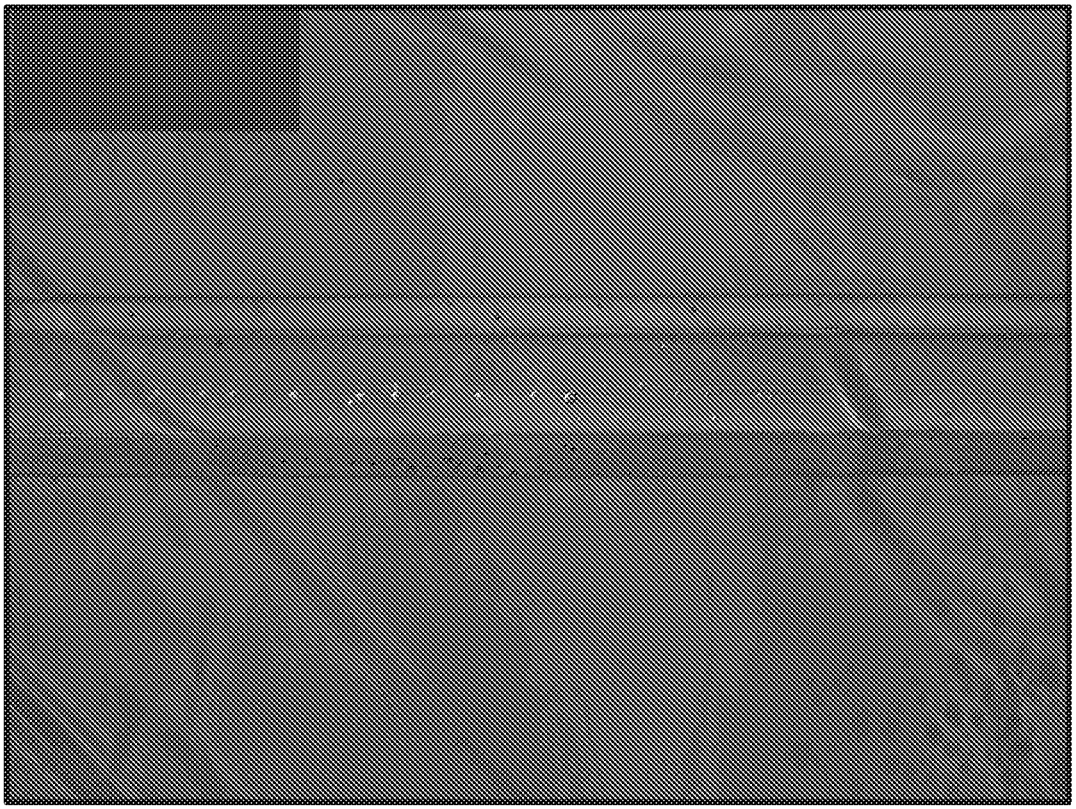
FIG. 2 is an illustration of a system including a tube immersed in and containing a fluid, the fluid and tube having an index of refraction difference of 0.02.

Referring to FIG. 2, a system having a tube immersed in and containing a fluid is illustrated. The delta of the system is approximately 0.02. The low visibility optical effect of the tube within the system is illustrated by a comparison between the systems of FIG. 1 and FIG. 2. As demonstrated in FIG. 1, the features of the tube, such as the inner wall and outer wall, are distinctly visible, however, these same features as illustrated in FIG. 2 are not distinct and less visible. The reduction of the delta from 0.10 in FIGS. 1 to 0.02 in FIG. 2, substantially reduces the visibility of the features of the tube to provide a low visibility optical effect.

Figure 3:
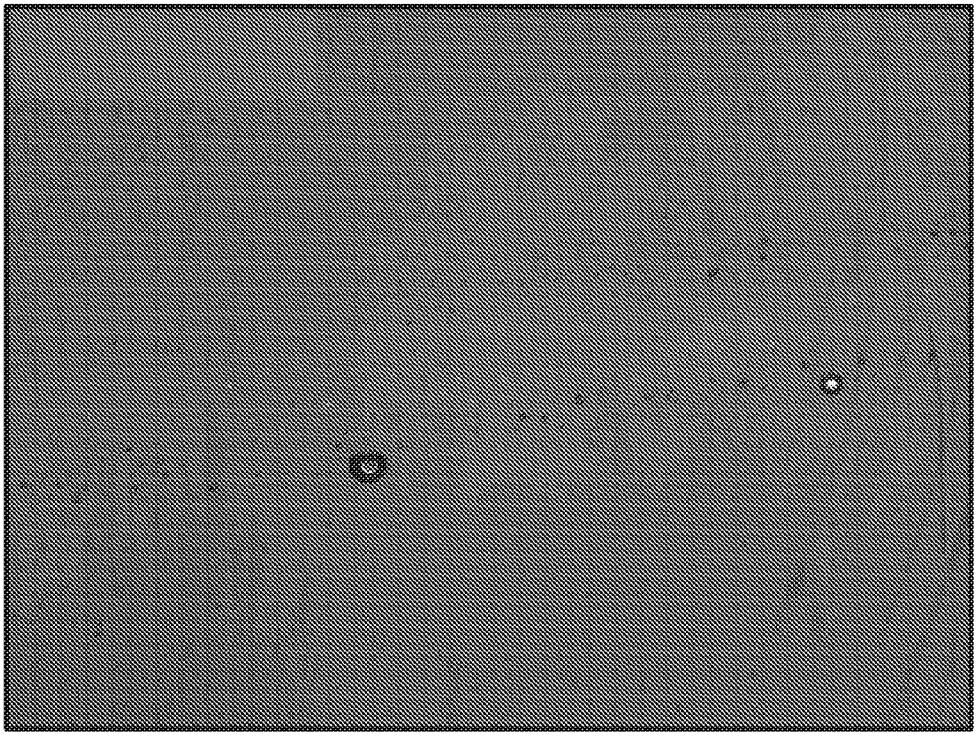
FIG. 3 is an illustration of a system including a tube immersed in and containing a fluid, the fluid and tube having an index of refraction difference of 0.00.

FIG. 3 illustrates a system in which a tube is both immersed in and contains a fluid in which the delta is approximately 0.00 (zero). The low visibility optical effect of the system having a low delta is demonstrated by a comparison between the system of FIG. 1 and the system of FIG. 3. As demonstrated in FIG. 1, the features of the tube, such as the inner and outer edges of the wall that are distinctly visible in FIG. 1 are noticeably less visible in FIG. 3, such that the tube has a low visibility optical effect and is substantially invisible within the system.

Figure 4:
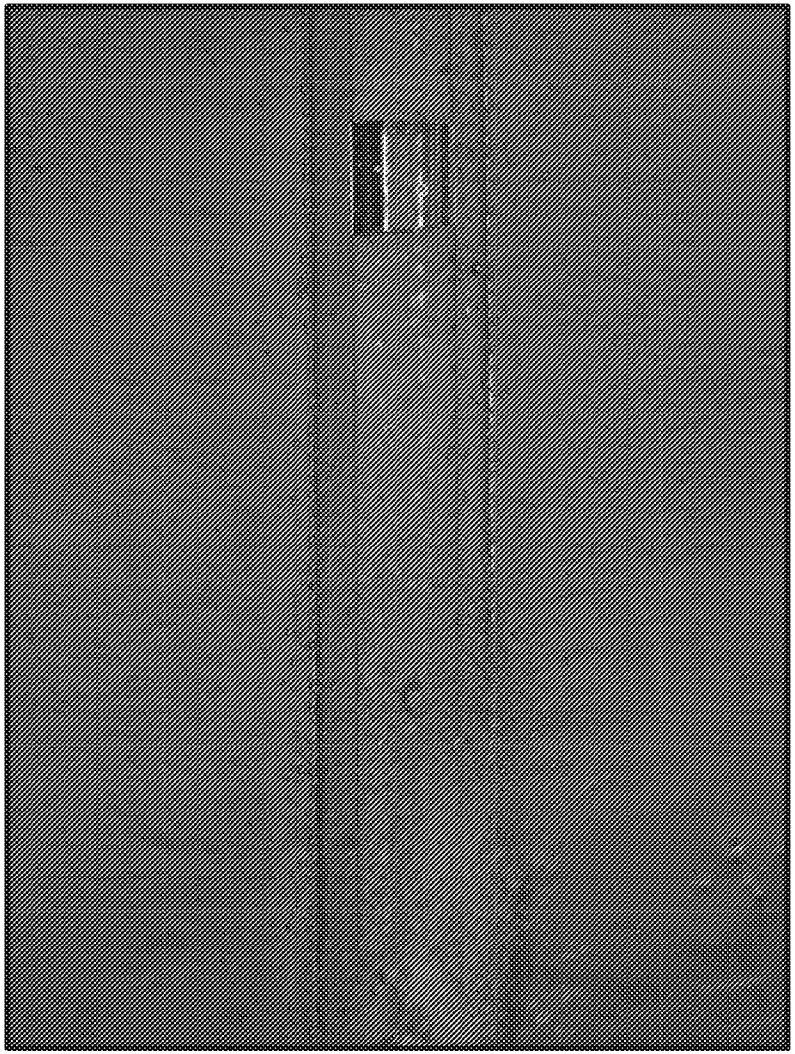
FIG. 4 is an illustration of a system including a tube immersed in and containing a fluid, the fluid and tube having an index of refraction difference of 0.02.

FIG. 4 illustrates a system in which a tube is both immersed in and contains a fluid in which the delta is approximately 0.02. Here, unlike the embodiments described above in connection with FIGS. 1 and 2, the refractive index of the liquid is greater than the tube. The low visibility optical effect of the system having a delta of 0.02 is demonstrated by a comparison of FIG. 4 to both FIGS. 1 and 2. As illustrated in FIG. 1, the features of the tube, such as the inner and outer edges of the wall are distinctly visible, however such features are noticeably less visible in FIG. 4 such that the tube has a low visibility optical effect. In a comparison of the systems of FIG. 4 and FIG. 2, the visibility of the tubes in either of the systems is roughly equivalent. The comparison of the low visibility optical effect is enhanced by the presence of an air pocket within a portion of the tube illustrated in FIG. 4. The presence of the air pocket within a portion of the tube demonstrates a portion of the system in which the delta is notably greater than 0.02. The inner wall and outer wall of the tube in the portion containing the air pocket is more visible than the portions of the tube containing the liquid. This comparison further illustrates the low visibility optical effect of providing a delta of about 0.02.

Figure 5:
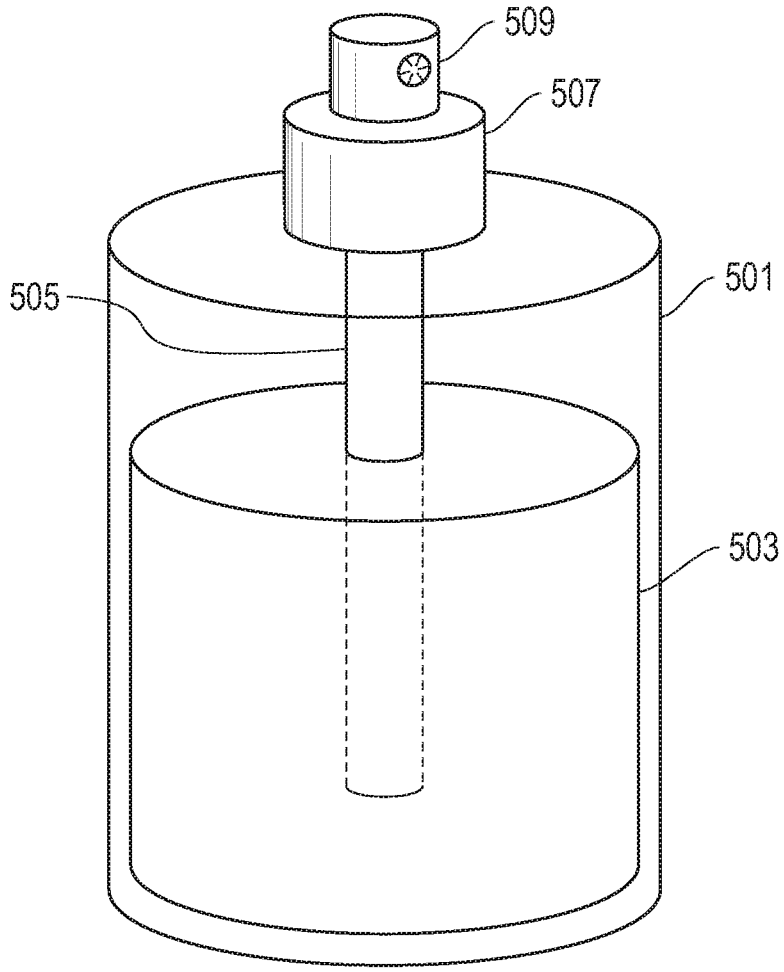
FIG. 5 is an illustration of a fragrance product including a container and dispenser assembly according to one embodiment.

FIG. 5 illustrates an embodiment of a fragrance product including a container 501 housing a liquid fragrance 503, and further including a dispenser assembly having a transport assembly composed of cap structure 507 and pump member 509. Downward depression of pump member causes dispensing of the liquid fragrance, most often in an atomized fashion. The dispenser assembly further includes tube 505 that essentially disappears as it extends into the liquid fragrance 503, and functions to feed the transport assembly with continued supply of liquid fragrance until most of the liquid fragrance is used. In practice, embodiments have demonstrated a remarkable ability to achieve an almost completely disappearing tube as it extends into the liquid fragrance. When full, the fragrance product appears entirely 'tubeless,' the tube being virtually indiscernible upon casual inspection.

While the invention has been illustrated and described in the context of particular embodiments, it is not intended to be limited to the details shown, since various modifications and substitutions can be made without departing in any way from the scope of the present invention. For example, additional or equivalent substitutes can be provided and additional or equivalent production steps can be employed. As such, further modifications and equivalents of the invention herein disclosed may occur to persons skilled in the art using no more than routine experimentation, and all such modifications and equivalents are believed to be within the scope of the invention as defined by the following claims.

What is claimed is:

1. A fragrance product, comprising:

a container containing a liquid fragrance; and a dispenser assembly for dispensing the liquid fragrance, comprising:

a pump; and a tube connected to the pump;

wherein the tube comprises at least one crystalline fluoropolymer material chosen from at least one of ethylene tetrafluoroethylene and/or modified ethylene tetrafluoroethylene, and the tube has a refractive index of not greater than about 1.40.

2. The fragrance product of claim 1, wherein the tube further comprises at lease one fluoropolymer material chosen from at least one of polytetrafluoroethylene (PTFE), tetrafluoroethylene and perfluoroalkyl vinyl ether (PFA), tetrafluoroethylene and hexafluoropropylene (FEP), tetrafluoroethylene and ethylene (ETFE), polyvinylidene fluoride (PVDF), polycholorotrifluoroethylene (PCTFE), polyfluroacrylates, polytrifluoroacetate, and tetrafluoroethylene and hexafluoropropylene and vinylidene fluoride (THV).

3. The fragrance product of claim 1, wherein the fluoropolymer material is modified ethylene tetrafluoroethylene.

4. The fragrance product of claim 1, wherein the fluoropolymer material has a controlled crystalline content.

5. The fragrance product of claim 1, wherein the tube has a refractive index of not greater than 1.38.

6. The fragrance product of claim 1, wherein the tube has a transparency of not less than about 80%.

7. The fragrance product of claim 1, wherein the liquid fragrance has a refractive index, and the difference between the refractive index of the tube and of the liquid fragrance is not greater than about 0.04.

8. The fragrance product of claim 1, wherein the liquid fragrance has a refractive index, and the difference between the refractive index of the tube and of the liquid fragrance is not greater than about 0.02.

9. The product of claim 1, wherein the fluoropolymer material is ethylene tetrafluoroethylene.

* * * * *